US006890065B1

(12) United States Patent
Spivey et al.

(10) Patent No.: US 6,890,065 B1
(45) Date of Patent: May 10, 2005

(54) HEATER CHIP FOR AN INKJET PRINTHEAD

(75) Inventors: Paul Timothy Spivey, Lexington, KY (US); Carl Edmond Sullivan, Versailles, KY (US); Kent Lee Ubellacker, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/625,345

(22) Filed: Jul. 25, 2000

(51) Int. Cl.[7] ..... B41J 2/05

(52) U.S. Cl. ..... 347/63; 347/65; 347/102; 347/87

(58) Field of Search ..... 347/63, 65, 102, 347/87, 200; 216/27

(56) References Cited

U.S. PATENT DOCUMENTS

| | | | | |
|---|---|---|---|---|
| 4,622,574 A | | 11/1986 | Garcia | |
| 4,875,968 A | | 10/1989 | O'Neill et al. | |
| 5,120,665 A | | 6/1992 | Tsukagoshi et al. | |
| 5,245,750 A | | 9/1993 | Crumly et al. | |
| 5,389,193 A | | 2/1995 | Coucoulas et al. | |
| 5,466,558 A | | 11/1995 | Sasaki | |
| 5,480,834 A | | 1/1996 | Lake et al. | |
| 5,665,249 A | | 9/1997 | Burke et al. | |
| 5,693,181 A | | 12/1997 | Bernstein | |
| 5,751,324 A | * | 5/1998 | Brandon et al. | 347/87 |
| 5,779,837 A | * | 7/1998 | Harvey | 156/153 |
| 5,821,961 A | * | 10/1998 | Sato | 347/63 |
| 5,821,972 A | * | 10/1998 | Mey et al. | 347/153 |
| 5,842,258 A | | 12/1998 | Harvey et al. | |
| 5,863,812 A | | 1/1999 | Manteghi | |
| 5,866,951 A | | 2/1999 | Gademann et al. | |
| 5,871,657 A | | 2/1999 | Nelson | |
| 5,918,113 A | | 6/1999 | Higashi et al. | |
| 6,000,787 A | | 12/1999 | Weber et al. | |
| 6,013,581 A | | 1/2000 | Wu et al. | |
| 6,033,581 A | * | 3/2000 | Kobayashi | 216/27 |
| 6,209,993 B1 | | 4/2001 | Wang et al. | 347/65 |

* cited by examiner

*Primary Examiner*—Stephen D. Meler
*Assistant Examiner*—Ly Tran
(74) *Attorney, Agent, or Firm*—Taylor & Aust, P.C.

(57) ABSTRACT

An ink jet printhead assembly includes a heater chip having a backside with at least one cavity. A substrate is associated with the backside of the heater chip. Adhesive is at least partially disposed within the at least one cavity. The adhesive adheres the backside of the heater chip to the substrate.

18 Claims, 7 Drawing Sheets

HEATER CHIP FOR AN INKJET PRINTHEAD

BACKGROUND OF THE INVENTION

1. Field of the Invention

The present invention relates to ink jet printheads, and, more particularly, to a heater chip for an ink jet printhead.

2. Description of the Related Art

A printhead in an ink jet printer includes a silicon heater chip 10 (FIG. 1*a*), also termed a "die," containing a plurality of heating devices (not shown). Chip 10 has a single via 12. However, it is also possible for a chip to have multiple vias 12, such as chip 14 (FIG. 1*b*) or chip 16 (FIG. 1*c*). Other variations are of course possible. Each via 12 supplies ink from the backside of the heater chip to the front side of the chip, which is where the heating devices are located.

It is known for a line of die attach adhesive to be dispensed onto a substrate in order to attach the heater chip to the substrate. Since adjacent ones of vias 12 may carry different colors of ink, the line of die attach adhesive must seal around and between each via 12 in order to prevent the inks from mixing together. A problem is that there are no features on the backside of the chips to control the die attach adhesive flow during placement and cure.

To meet the increasing demands on ink jet print quality, the packaging technology must provide better thermal management, more efficient use of space, and precision alignment of ejector nozzles. For thermal management, the die attach adhesive plays a key role. The bond line must be controlled in every dimension. Both the placement, in relation to the substrate and via, and the thickness of the bond line are important. As it is attempted to incorporate more devices on each chip, more chips on each head, and all in a smaller package, there is less room for making the necessary ink seals.

In one known method, die attach adhesive 18 (FIG. 2*a*) is dispensed onto a substrate 20, and a chip 22 is brought into contact with adhesive 18. Adhesive 18 is forced to flow laterally as chip 22 is lowered into place in the direction indicated by arrow 24 (FIG. 2*b*). This lateral flow of adhesive 18 can result in a very wide bond line in the X direction as the height of the bond line in the Z direction is decreased.

What is needed in the art is a heater chip that can be adhered to a substrate such that greater control of the die attach adhesive is maintained.

SUMMARY OF THE INVENTION

The present invention provides a heater chip with a trench on its backside for controlling the die attach adhesive.

The invention comprises, in one form thereof, an ink jet printhead assembly. The printhead assembly includes a heater chip having a backside with at least one cavity. A substrate is associated with the backside of the heater chip. Adhesive is at least partially disposed within the at least one cavity. The adhesive adheres the backside of the heater chip to the substrate.

An advantage of the present invention is that the flow of the die attach adhesive can be precisely controlled.

Another advantage is that a very accurate and precise bond line is provided.

Yet another advantage is that a greater surface area of the chip is available for bonding over a given X distance on the chip.

A further advantage is that, for a set amount of adhesive, the height of the bond line in the Z direction and the width of the bond line in the X direction are greatly decreased.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 3:
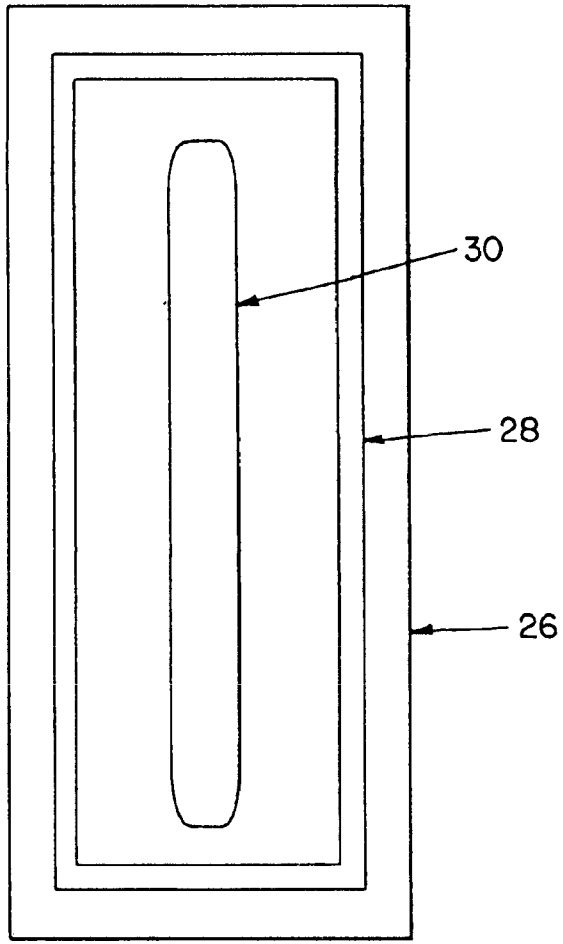
FIG. 3 is a backside view of a first embodiment of a heater chip of the present invention.

In FIG. 3 there is shown one embodiment of a silicon heater chip 26 of the present invention. Heater chip 26 includes a trench 28 encircling or surrounding a single ink via 30. The pattern of trench 28 could be created through micromachining techniques or by laser ablation with, for example, an yttrium aluminum garnet (YAG) laser.

Figure 4A:
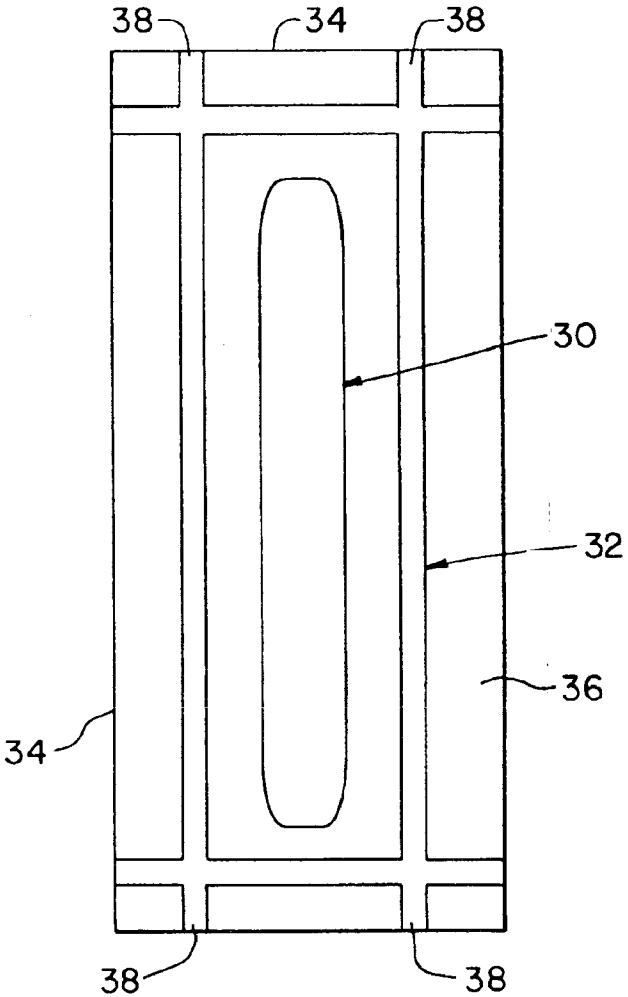
FIG. 4*a* is a backside view of a second embodiment of a heater chip of the present invention.
Figure 4B:
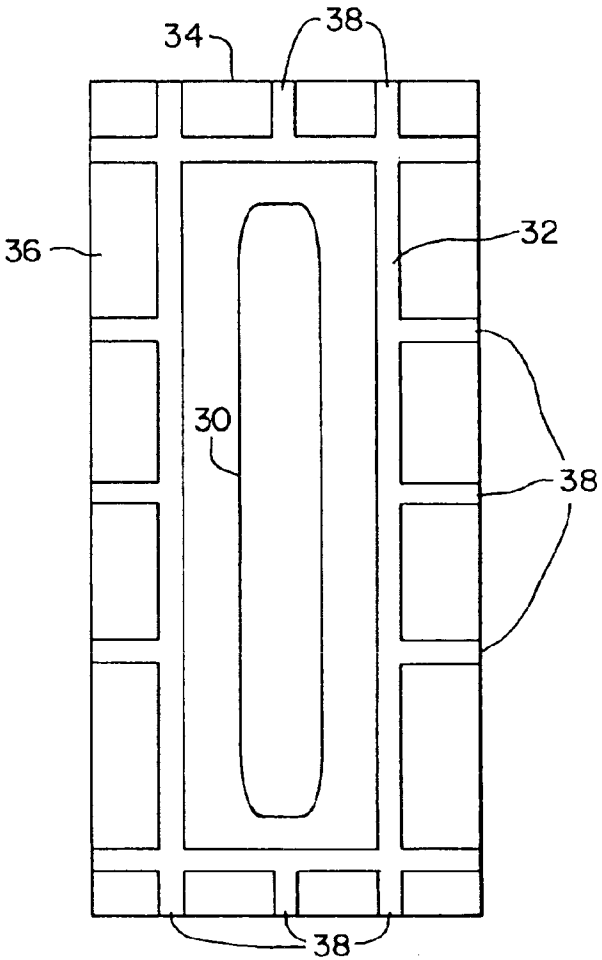
FIG. 4*b* is a backside view of a third embodiment of a heater chip of the present invention.

In another embodiment (FIG. 4*a*), a trench 32 extends to the outside edges 34 of a chip 36 in each corner of chip 36. Thus, vents 38 are provided for the die attach adhesive to outgas during cure. The pattern of trench 32 can be created through micromachining techniques, by dicing with a dicing saw, or by laser ablation with a YAG laser. In yet another embodiment (FIG. 4*b*), additional vents 38 are provided by use of wet or dry micromachining or laser cutting techniques.

Figure 5C:
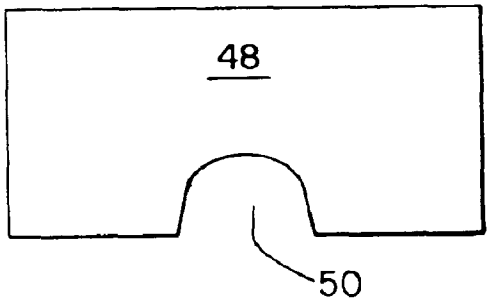
FIG. 5*c* is a side view of a sixth embodiment of a heater chip of the present invention.
Figure 5B:
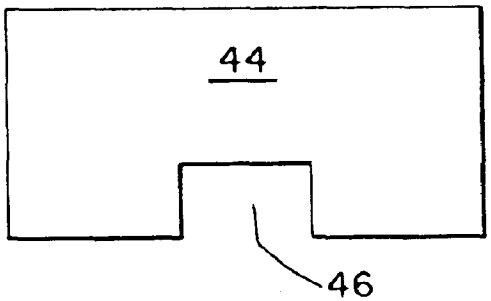
FIG. 5*b* is a side view of a fifth embodiment of a heater chip of the present invention.
Figure 5A:
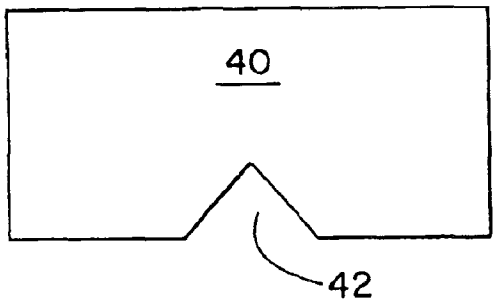
FIG. 5*a* is a side view of a fourth embodiment of a heater chip of the present invention.

The results of cutting into a silicon chip via micromachining, dicing and YAG laser ablation are shown in FIGS. 5*a*, 5*b* and 5*c*, respectively. As can be seen in FIG. 5*a*, micromachining a chip 40 using wet chemical etch methods and (100) silicon produces a trench 42 having a triangular cross section. Such wet micromachining techniques may include the use of potassium hydroxide (KOH) or tetramethyl ammonium hydroxide (TMAN) to etch the silicon. Micromachining using dry etching techniques, such as deep reactive ion etch (DRIE) or reactive ion etch (RIE), would result in a trench having a differently shaped cross section, such as rounded or square.

As shown in FIG. 5*b*, dicing a chip 44 produces a trench 46 having a rectangular cross section. Finally, YAG laser ablation of a chip 48 (FIG. 5*c*) produces a trench 50 have a rounded cross section.

Figure 1A:
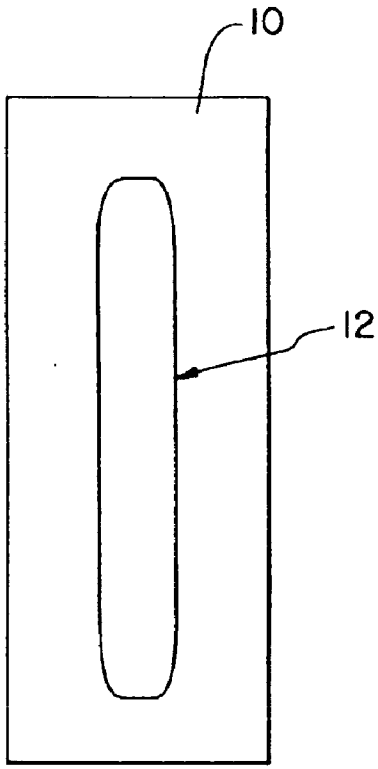
PRIOR ART Fig. 1A
FIG. 1*a* is a backside view of a known heater chip with a single via.
Figure 1B:
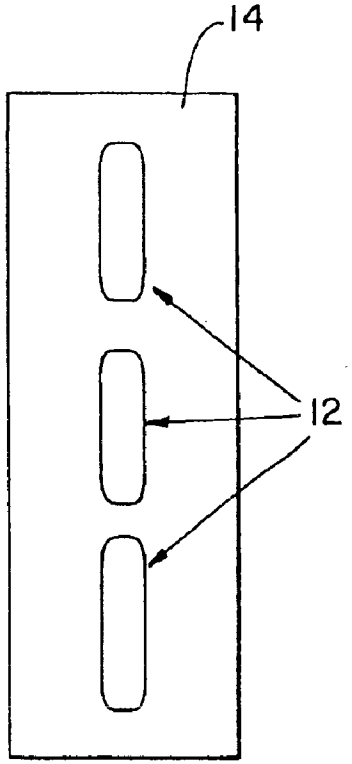
PRIOR ART Fig. 1B
FIG. 1*b* is a backside view of a known heater chip with multiple vias.
Figure 1C:
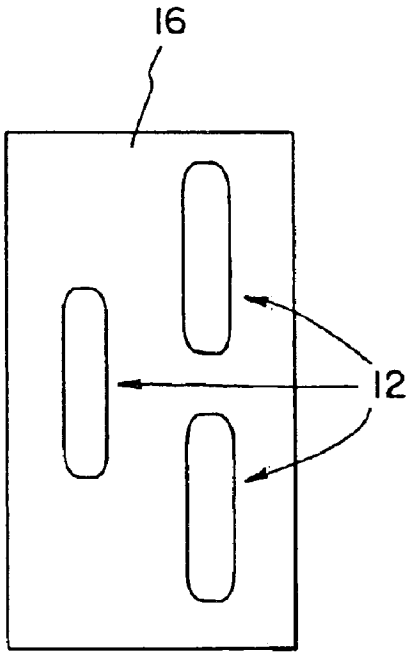
PRIOR ART Fig. 1C
FIG. 1*c* is a backside view of another known heater chip with multiple vias.
Figure 2B:
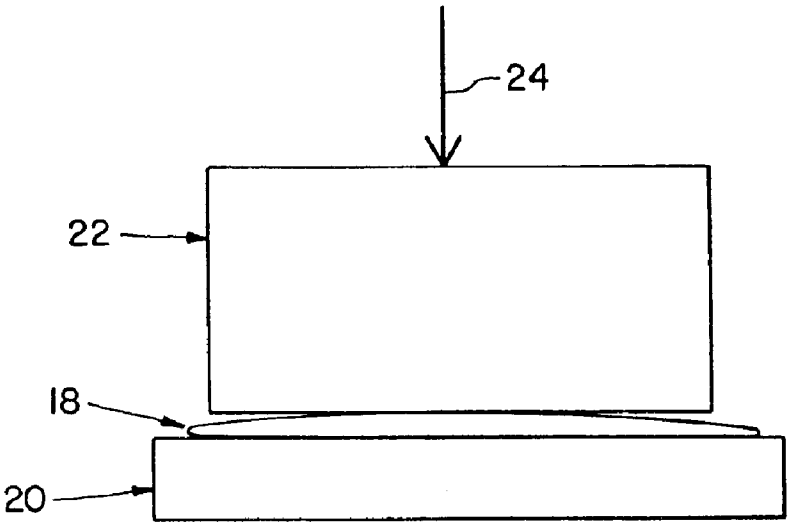
PRIOR ART Fig. 2B
FIG. 2*b* is a side view of a second step in adhering a known heater chip to a substrate.
Figure 2A:
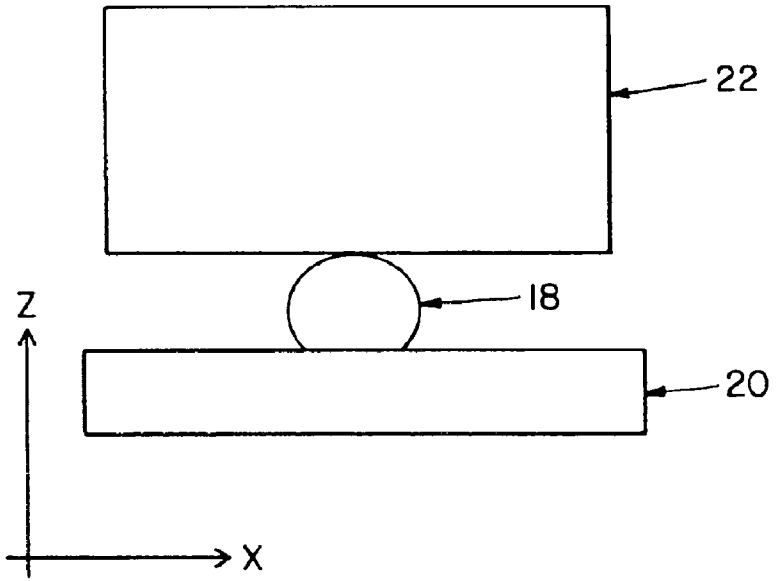
PRIOR ART Fig. 2A
FIG. 2*a* is a side view of a first step in adhering a known heater chip to a substrate.
Figure 6B:
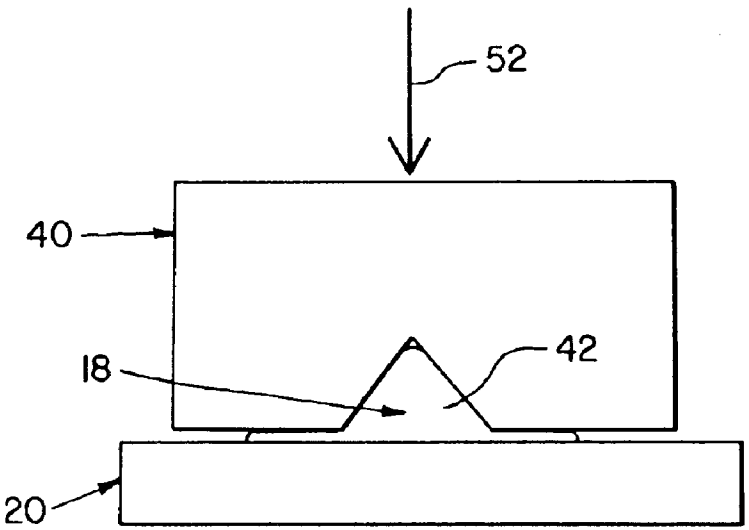
FIG. 6*b* is a side view of a second step in adhering the heater chip of FIG. 5*a* to a substrate.
Figure 6A:
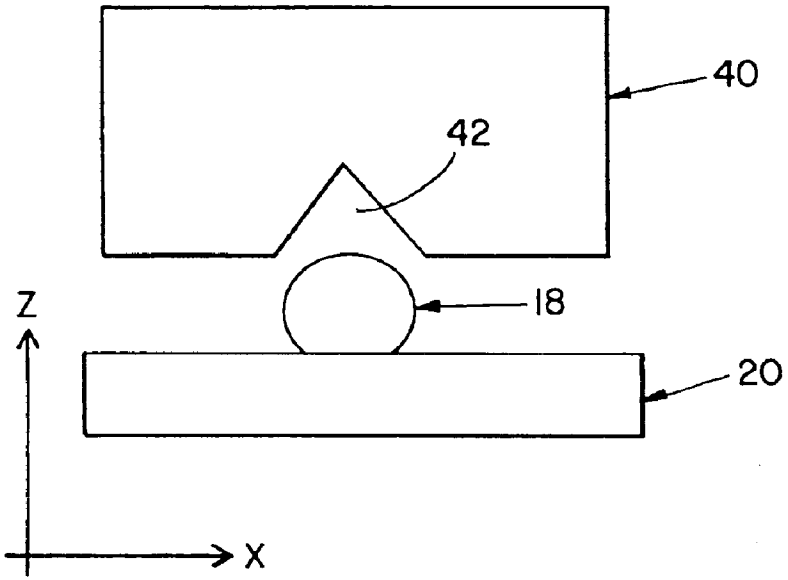
FIG. 6*a* is a side view of a first step in adhering the heater chip of FIG. 5*a* to a substrate.

FIGS. 6*a* and 6*b* illustrate the process of adhering heater chip 40 to substrate 20. In FIG. 6*a*, similarly to FIG. 2*a*, die attach adhesive 18 is dispensed onto substrate 20 and chip 40 is brought into contact with adhesive 18. In FIG. 6*b*, as in FIG. 2*b*, adhesive 18 is forced to flow laterally as chip 40 is lowered into place in the direction indicated by arrow 52. As can be seen in a comparison of FIGS. 2*b* and 6*b*, trench 42 reduces the extent of the lateral flow of adhesive 18 as the height of the bond line in the Z direction is decreased. That is, trench 42 reduces the width of the bond line in the X direction. The presence of trench 42 on the backside of silicon chip 40 enables tight control over where die attach adhesive 18 is allowed to flow, which provides a very accurate and precise bond line. It is also possible for adhesive 18 to be entirely contained within the trench 42, thereby further increasing the accuracy and precision of the bond line. For a set amount of adhesive 18, the height of the bond line in the Z direction and the width of the bond line in the X direction are greatly decreased by the presence of trench 42. Trench 42 also provides chip 40 with a greater surface area that can be bonded to over a given X distance on chip 40.

Figure 7:
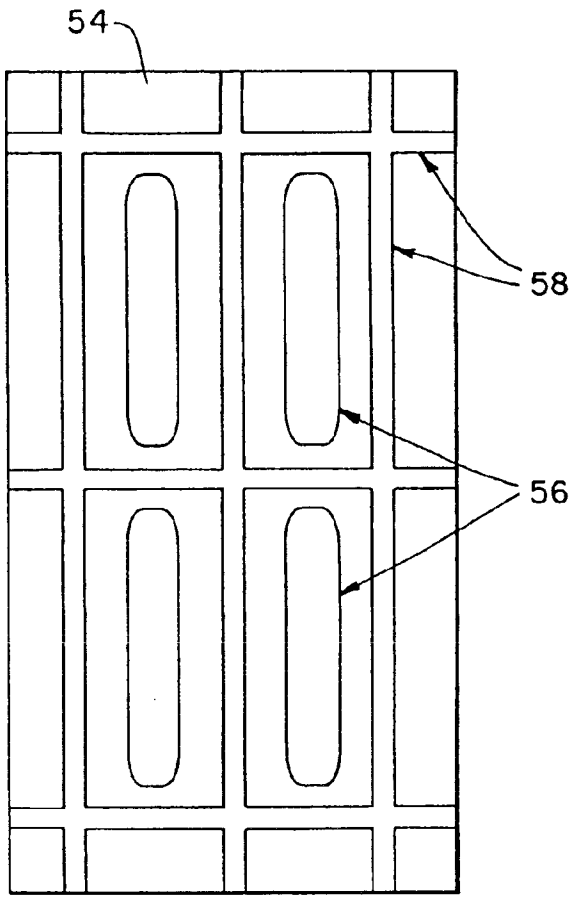
FIG. 7 is a backside view of a seventh embodiment of a heater chip of the present invention.

A precise bond line is especially important for applications that require multiple ink vias. Heater chip 54 (FIG. 7) includes multiple ink vias 56 separated by trenches 58. Since each of vias 56 may carry a different color ink, sealing between ink vias 56 is crucial to prevent cross contamination between different colored inks.

Figure 8:
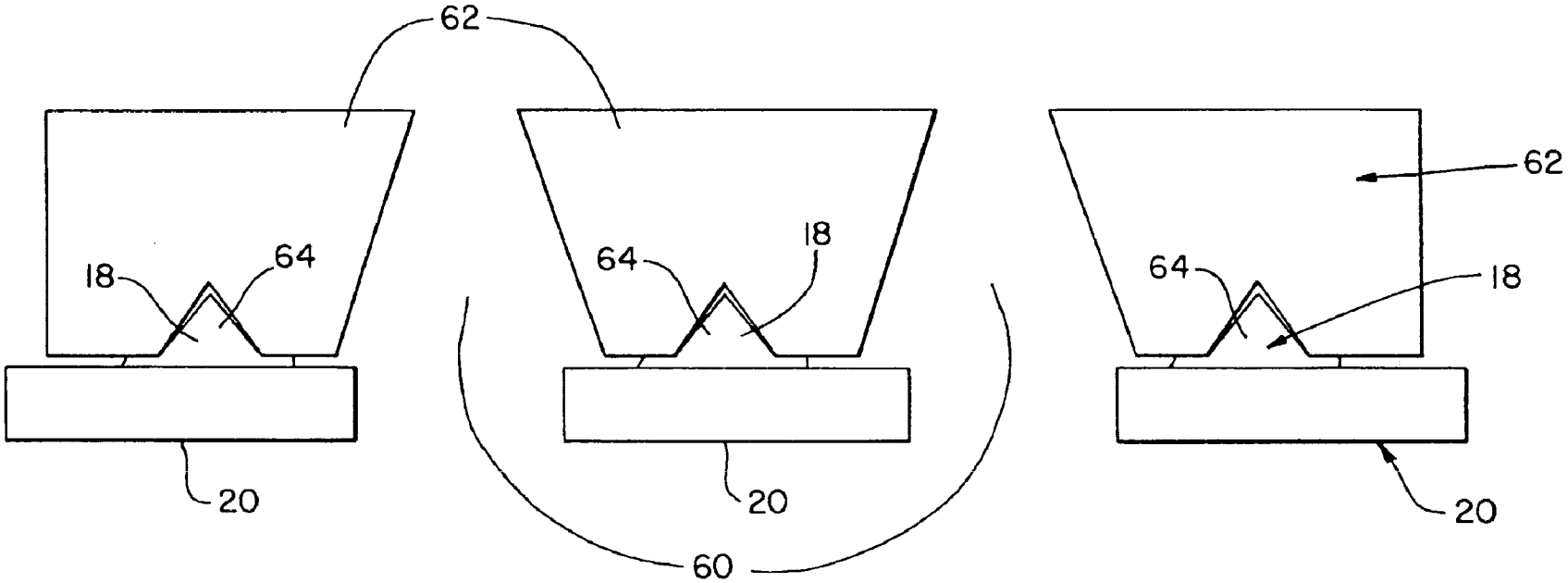
FIG. 8 is a side view of an eighth embodiment of a heater chip of the present invention adhered to a substrate.

As the market place requires printers to have ever increasing print speeds, the delivery rate of ink to the heaters must also increase, which requires wider ink vias, such as vias 60 (FIG. 8) in heater chip 62. Wider ink vias result in the chip having less area where a seal can be established between two adjacent ink vias. By providing a greater surface area for bonding, trenches 64 improve the integrity of the bond lines in small areas, such as between multiple ink vias on a given chip.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printhead assembly, comprising:

a heater chip including a backside with at least one cavity;

a substrate associated with said backside of said heater chip, said substrate having a substantially flat surface opposing said at least one cavity; and adhesive at least partially disposed within said at least one cavity, said adhesive adhering said backside of said heater chip to said substantially flat surface of said substrate;

wherein said at least one cavity comprises at least one trench; and wherein said heater chip includes a plurality of ink vias, said adhesive being configured for preventing fluid communication between said plurality of ink vias in an area defined between said heater chip and said substrate.

2. The printhead assembly of claim 1, wherein said heater chip includes at least one outside edge, said at least one trench extending to said at least one outside edge to thereby form at least one vent.

3. The printhead assembly of claim 2, wherein said at least one vent is configured for allowing said adhesive to outgas during curing.

4. An ink jet printhead assembly, comprising:

a heater chip including a backside with at least one cavity;

a substrate associated with said backside of said heater chip, said substrate having a substantially flat surface; and adhesive substantially entirely disposed within said at least one cavity, said adhesive adhering said backside of said heater chip to said substantially flat surface of said substrate.

5. A heater chip assembly for use in an ink jet printhead, said heater chip assembly including:

a heater chip including a backside having at least one cavity; and adhesive substantially entirely contained within said at least one cavity, said adhesive configured for adhering said backside of said heater chip to a substrate.

6. The heater chip of claim 5, wherein said at least one cavity comprises at least one trench.

7. The heater chip of claim 6, wherein said heater chip includes at least one ink via.

8. The heater chip of claim 7, wherein said at least one trench substantially surrounds each said via.

9. The heater chip of claim 6, wherein said heater chip includes at least one outside edge, said at least one trench extending to said at least one outside edge to thereby form at least one vent.

10. The heater chip of claim 9, wherein said at least one vent is configured for allowing said adhesive to outgas during curing.

11. A method of assembling an ink jet printhead, said method comprising the steps of:

micromachining at least one cavity in a backside of a heater chip, said heater chip including a plurality of vias, each of said at least one cavity surrounding a corresponding one of said plurality of vias, said at least one cavity being configured to reduce a width of a bond line between adjacent vias of said plurality of vias; and adhering said backside of said heater chip to a substantially flat surface of a substrate such that adhesive is at least partially disposed within said at least one cavity.

12. The method of claim 11, wherein said micromachining step includes cutting said at least one cavity into said heater chip.

13. The method of claim 11, wherein said adhering step includes the substeps of:

dispensing said adhesive onto said substrate;

aligning said at least one cavity with said adhesive; and pressing said heater chip and said substrate together.

14. The method of claim 11, wherein said at least one cavity comprises at least one trench.

15. The method of claim 14, wherein said heater chip includes at least one outside edge, said at least one trench extending to said at least one outside edge to thereby form at least one vent, said method comprising the further step of allowing said adhesive to outgas through said at least one vent during curing.

16. An ink jet printhead assembly, comprising:

a heater chip having a backside, said heater chip including a plurality of vias and a plurality of trenches, each via of said plurality of vias surrounded by a corresponding trench of said plurality of trenches;

a substrate associated with said backside of said heater chip, said substrate having a substantially flat surface opposing said plurality of trenches; and adhesive substantially entirely contained within each of said plurality of trenches, said adhesive adhering said backside of said heater chip to said substantially flat surface of said substrate, said adhesive sealing to completely prevent a flow of ink between said plurality of vias.

17. The printhead assembly of claim 16, each trench of said plurality of trenches being configured to reduce a width of a bond line between adjacent vias of said plurality of vias.

18. The printhead assembly of claim 16, each trench of said plurality of trenches and said adhesive configured to reduce a seal area between adjacent vias of said plurality of vias.

* * * * *